United States Patent [19]

Morito et al.

[11] 4,242,155

[45] Dec. 30, 1980

[54] METHOD OF FORMING AN INSULATING FILM ON A GRAIN-ORIENTED SILICON STEEL SHEET

[75] Inventors: Nobuyuki Morito; Toshitomo Sugiyama; Yasuo Yokoyama, all of Kobe; Toshio Ichida, Chiba, all of Japan

[73] Assignee: Kawasaki Steel Corporation, Kobe, Japan

[21] Appl. No.: 32,650

[22] Filed: Apr. 23, 1979

[30] Foreign Application Priority Data

Apr. 28, 1978 [JP] Japan ..... 53/51038

[51] Int. Cl.[3] ..... H01F 1/04

[52] U.S. Cl. ..... 148/113; 148/27

[58] Field of Search ..... 148/27, 113; 427/127

[56] References Cited

U.S. PATENT DOCUMENTS

| | | | |
|---|---|---|---|
| 2,394,047 | 2/1946 | Elsey et al. | 148/6 |
| 3,477,881 | 11/1969 | Wada et al. | 148/113 |
| 3,582,407 | 6/1971 | Steger et al. | 148/27 |
| 3,627,594 | 12/1971 | Yamamoto et al. | 148/31.55 |
| 3,930,905 | 1/1976 | Akerblom | 148/113 |
| 3,959,034 | 5/1976 | Akerblom | 148/113 |
| 4,010,050 | 3/1977 | Choby | 148/27 |

*Primary Examiner*—L. Dewayne Rutledge
*Assistant Examiner*—John P. Sheehan
*Attorney, Agent, or Firm*—Balogh, Osann, Kramer, Dvorak, Genova & Traub

[57] ABSTRACT

A highly adhesive and uniform insulating film can be formed on a grain-oriented silicon steel sheet without deteriorating the iron loss of the steel sheet by the use of a magnesia series annealing separator containing a strontium compound.

1 Claim, 2 Drawing Figures

(X1000)

(X1000)

METHOD OF FORMING AN INSULATING FILM ON A GRAIN-ORIENTED SILICON STEEL SHEET

BACKGROUND OF THE INVENTION

1. Field of the Invention

The present invention relates to a method of forming an insulating film on a grain-oriented silicon steel sheet. Particularly, the present invention relates to a method of forming a highly adhesive and uniform insulating film on a grain-oriented silicon steel sheet having a low iron loss.

2. Description of the Prior Art

Grain-oriented silicon steel sheet is generally produced through a series of steps, wherein a silicon steel raw material containing not more than 4.0% by weight of silicon is hot rolled, the hot rolled sheet is annealed and then subjected to one cold rolling or two cold rollings with an intermediate annealing between them to produce a cold rolled sheet having a final gauge, and the cold rolled sheet is subjected to a primary recrystallization annealing to remove carbon in the steel sheet at the same time and then subjected to a final annealing to develop secondarily recrystallized grains having a (110)[001] orientation and at the same time to remove harmful impurities and to form a forsterite insulating film.

The forsterite film formed at the final annealing in the above described conventional method is not present uniformly and smoothly only on the surface layer of the steel sheet. That is, in the film formed by the conventional method, as illustrated by a photomicrograph (magnification: 1,000) of the cross-section of the film formed on the surface of the steel sheet shown in FIG. 1, a large number of forsterite grains are present not only on the outermost surface layer of the steel sheet, but also even at a position several μm directly beneath the surface of the steel sheet. The forsterite grains formed directly beneath the surface of a silicon steel sheet hinder the magnetic domain wall migration and cause a high iron loss of the steel sheet.

In the conventional method, in order to decrease the formation of those forsterite grains, the decarburizationannealing is carried out so as to form a thin subscale layer, whereby a forsterite film having a thickness of as small as possible is formed at the final annealing. Although the forsterite film formed by the above described method is satisfactory in the magnetic properties, the film is extremely poor in the adhesion and further is insufficient in the electric insulating property. That is, when it is intended to secure practically satisfactory film properties by the conventional method, forsterite grains are always formed directly beneath the steel sheet surface.

SUMMARY OF THE INVENTION

The object of the present invention is to provide a method of forming an improved insulating film, which has not the drawbacks of an insulating film formed on a grain-oriented silicon steel sheet by the above described conventional method.

The feature of the present invention is the provision of a method of forming a highly adhesive and uniform insulating film on a grain-oriented silicon steel sheet without deteriorating the iron loss of the steel sheet, wherein a cold rolled silicon steel sheet having a final gauge is subjected to a decarburization annealing to form a silica-ontaining subscale on the surface, applied with an annealing separator consisting mainly of magnesia on the subscale, and subjected to a final annealing to form an insulating film on the steel sheet, an improvement comprising using a magnesia series annealing separator containing 0.1–10% by weight, calculated as strontium, of a strontium compound and further, if necessary, containing 0.5–5% by weight, calculated as titanium, of a titanium compound.

DETAILED DESCRIPTION OF THE INVENTION

Figure 1:
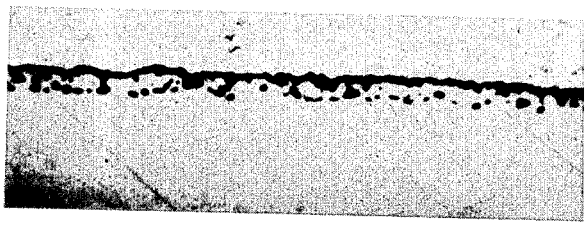
FIG. 1 is a microphotograph (magnification: 1,000) of a cross-section of an insulating film formed on a grain-oriented silicon steel sheet by the use of a conventional annealing separator consisting mainly of magnesia.
Figure 2:
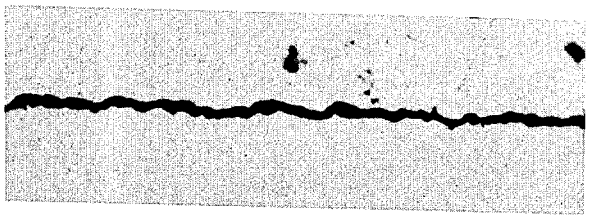
FIG. 2 is a microphotograph (magnification: 1,000) of a cross-section of an insulating film formed on a grain-oriented silicon steel sheet by the use of an annealing separator consisting mainly of magnesia and containing 1% by weight of strontium sulfate according to the present invention.

The inventors have found the following phenomenon. When an insulating film is formed on a silicon steel sheet by the use of an annealing separator consisting mainly of magnesia and containing a strontium compound, forsterite grains are not at all formed just beneath the surface of the steel sheet, but the forsterite grains are wholly formed on the outermost layer of the steel sheet surface as illustrated by a photomicrograph (magnification: 1,000) of a cross-section of the film formed on the steel sheet surface shown by FIG. 2, and the resulting grain-oriented silicon steel has a very low iron loss and further the resulting film has a high adhesion to the steel sheet and a uniform dark grey color and a beautiful appearance. That is, according to the present invention, an insulating film can be formed on a grain-oriented silicon steel sheet without the formation of forsterite grains directly beneath the surface of the steel sheet, and without deteriorating the adhesion of the film with the steel sheet, the electric insulating properties of the film and the iron loss of the steel sheet by the use of a magnesia series annealing separator containing a strontium compound.

The present invention will be explained in more detail referring to the following experimental examples.

EXPERIMENTAL EXAMPLE 1

A silicon steel raw material containing 3.10% of Si, 0.02% of S and 0.06% of Mn was hot rolled into a thickness of 3 mm, annealed at 950° C. for 5 minutes, and subjected to two cold rollings with an intermediate annealing at 900° C. for 3 minutes between them to produce a cold rolled sheet having a final gauge of 0.3 mm. Then, the cold rolled sheet was subjected to a decarburization annealing at 820° C. for 3 minutes in wet hydrogen, applied with an annealing separator consisting of 0–10%, calculated as strontium, of strontium sulfate and the remainder being magnesia and subjected to a final annealing at 1,180° C. for 5 hours to obtain a final product of a grain-oriented silicon steel sheet having a forsterite insulating film formed thereon. The magnetic properties of the product and the adhesion of the insulating film to the steel sheet are shown in the following Table 1.

TABLE 1

| | Sr (%) | | | | | | | |
|---|---|---|---|---|---|---|---|---|
| | 0 | 0.1 | 0.3 | 0.5 | 1 | 3 | 5 | 10 |
| $B_{10}$ (T) | 1.86 | 1.86 | 1.86 | 1.87 | 1.87 | 1.86 | 1.86 | 1.86 |
| $W_{17/50}$ (W/kg) | 1.24 | 1.22 | 1.22 | 1.18 | 1.16 | 1.17 | 1.19 | 1.23 |
| *Adhesion (mm) | 35 | 35 | 30 | 30 | 25 | 25 | 30 | 30 |

*Adhesion: Minimum diameter of a rod, which does not cause peeling of a film from a steel sheet at the bending of the steel sheet around the rod.

It can be seen from Table 1 that the use of a magnesia series annealing separator containing 0.1–10% by weight, preferably 0.5–5% by weight, calculated as strontium, of a strontium compound can decrease the iron loss of a grain-oriented silicon steel sheet and further improve the adhesion of an insulating film to the steel sheet.

EXPERIMENTAL EXAMPLE 2

A silicon steel raw material containing 3.10% of Si, 0.018% of Se and 0.055% of Mn was hot rolled into a thickness of 3 mm, annealed at 950° C. for 5 minutes, and subjected to two cold rollings with an intermediate annealing at 900° C. for 3 minutes between them to produce a cold rolled sheet having a final gauge of 0.30 mm. Then, the cold rolled sheet was subjected to a decarburization annealing at 820° C. for 3 minutes in wet hydrogen, applied with an annealing separator consisting of 0–10%, calculated as strontium, of strontium sulfate, 0–7%, calculated as titanium, of titania and the remainder being magnesia, and subjected to a final annealing at 1,180° C. for 5 hours to produce a final product of a grain-oriented silicon steel sheet having a forsterite insulating film formed thereon. The magnetic properties of the steel sheet and the adhesion of the film to the steel sheet are shown in the following Table 2.

TABLE 2

| | Ti | Sr (%) | | | | | |
|---|---|---|---|---|---|---|---|
| | (%) | 0 | 0.1 | 0.3 | 1 | 3 | 10 |
| $B_{10}$ (T) | | 1.85 | 1.85 | 1.86 | 1.85 | 1.86 | 1.85 |
| $W_{17/50}$ (W/kg) | 0 | 1.25 | 1.23 | 1.22 | 1.16 | 1.18 | 1.23 |
| Adhesion (mm)* | | 40 | 40 | 40 | 35 | 35 | 35 |
| $B_{10}$ (T) | | 1.85 | 1.85 | 1.86 | 1.86 | 1.85 | 1.85 |
| $W_{17/50}$ (W/kg) | 0.5 | 1.25 | 1.22 | 1.23 | 1.16 | 1.17 | 1.23 |
| Adhesion (mm) | | 35 | 35 | 30 | 30 | 30 | 25 |
| $B_{10}$ (T) | | 1.86 | 1.85 | 1.85 | 1.85 | 1.86 | 1.85 |
| $W_{17/50}$ (W/kg) | 1 | 1.24 | 1.23 | 1.20 | 1.17 | 1.18 | 1.24 |
| Adhesion (mm) | | 30 | 30 | 30 | 20 | 20 | 20 |
| $B_{10}$ (T) | | 1.85 | 1.85 | 1.86 | 1.85 | 1.85 | 1.85 |
| $W_{17/50}$ (W/kg) | 5 | 1.26 | 1.26 | 1.27 | 1.21 | 1.22 | 1.25 |
| Adhesion (mm) | | 30 | 30 | 25 | 20 | 20 | 25 |
| $B_{10}$ (T) | | 1.85 | 1.85 | 1.84 | 1.84 | 1.85 | 1.84 |
| $W_{17/50}$ (W/kg) | 7 | 1.26 | 1.26 | 1.28 | 1.28 | 1.30 | 1.30 |
| Adhesion (mm) | | 30 | 30 | 25 | 20 | 20 | 20 |

*Adhesion: Minimum diameter of a rod which does not cause peeling of a film from a steel sheet at the bending of the steel sheet around the rod.

It can be seen from Table 2 that 0.1–10% by weight of strontium and 0.5–5% by weight of titanium must be contained in a magnesia series annealing separator in order to obtain high magnetic properties and adhesion. An insulating film formed by the use of a magnesia series annealing separator containing strontium and titanium compounds within the above described range not only has a high adhesion, but also has a uniform beautiful dark grey color without forming any bare spots.

In general, the use of selenium as an inhibitor is inferior to the use of sulfur in the adhesion of the resulting film, but when a titanium compound is used together with a strontium compound in a magnesia series annealing separator for a silicon steel containing selenium, the resulting insulating film has an adhesion substantially the same as or superior to the adhesion of a film formed on a silicon steel containing sulfur described in the above Experimental example 1. However, an excessively large amount of titanium causes the deterioration of iron loss in the resulting grain-oriented silicon steel sheet, and the amount of titanium must be not larger than 5% by weight, and the amount of titanium within the range of 0.5–1% by weight gives a most excellent result.

According to the present invention, an annealing separator consisting mainly of magnesia is used, but compounds other than the above described strontium compound and titanium compound can be contained as an auxiliary component without departing from the object of the present invention. Further, the addition of a barium compound to the separator is effective for floating the forsterite grains formed directly beneath the surface of a steel sheet to the steel sheet surface and for forming a film adhered uniformly to the surface of the resulting grain-oriented silicon steel sheet, but deteriorates the adhesion of the resulting film and causes sometimes the peeling film.

The strontium compound to be used in the present invention includes at least one strontium compound selected from the group consisting of $SrSO_4$, $Sr(OH)_2.8H_2O$, $SrCO_3$ and $Sr(NO_3)_2$, and the titanium compound to be used in the present invention includes at least one titanium compound selected from the group consisting of $TiO_2$, $TiO_3.H_2O$, $Ti(OH)_4$ and $Ti(OH)_2$.

The following examples are given for the purpose of illustration of this invention and are not intended as limitations thereof.

EXAMPLE 1

A silicon steel ingot containing 0.030% of C, 2.98% of Si, 0.055% of Mn, 0.018% of Sb and 0.020% of Se was hot rolled into a thickness of 3 mm, annealed at 970° C. for 5 minutes, and subjected to two cold rollings with an intermediate annealing at 900° C. between them to produce a cold rolled sheet having a final gauge of 0.30 mm. The cold rolled sheet was subjected to a decarburization annealing, applied with a magnesia series annealing separator containing or not containing strontium hydroxide, and subjected to a final annealing at 850° C. for 50 hours and then at 1,180° C. for 5 hours. The following Table 3 shows the results.

TABLE 3

| | Properties | | |
|---|---|---|---|
| | $B_{10}$ (T) | $W_{17/50}$ (W/kg) | Adhesion (mm) |
| No addition | 1.92 | 1.11 | 40 |
| $Sr(OH)_2$:1% (calculated as Sr) | 1.93 | 1.07 | 35 |

EXAMPLE 2

A silicon steel ingot containing 0.025% of C, 3.10% of Si, 0.06% of Mn and 0.02% of S was hot rolled into a thickness of 3 mm, annealed at 950° C. for 5 minutes, and subjected to two cold rollings with an intermediate annealing at 900° C. between them to produce a cold rolled sheet having a final gauge of 0.30 mm. The cold rolled sheet was subjected to a decarburization annealing, applied with a magnesia series annealing separator containing or not containing a strontium compound, and subjected to a final annealing at 1,180° C. for 5 hours. The following Table 4 shows the result.

TABLE 4

| | Properties | | |
|---|---|---|---|
| | $B_{10}$ (T) | $W_{17/50}$ (W/kg) | Adhesion (mm) |
| No addition | 1.87 | 1.22 | 30 |
| $SrSO_4$:1% (calculated as Sr) | 1.88 | 1.15 | 25 |

It can be seen from Examples 1 and 2 that the use of a magnesia series annealing separator containing a strontium compound can produce a grain-oriented silicon steel sheet having a low iron loss without deteriorating the film property.

EXAMPLE 3

A silicon steel ingot containing 0.030% of C, 2.98% of Si, 0.055% of Mn, 0.018% of Sb and 0.020% of Se was hot rolled into a thickness of 3 mm, annealed at 970° C. for 5 minutes, and subjected to two cold rollings with an intermediate annealing at 900° C. between them to produce a cold rolled sheet having a final gauge of 0.30 mm. The cold rolled sheet was subjected to a decarburization annealing, applied with a magnesia series annealing separator containing or not containing a strontium compound and a titanium compound, and subjected to a final annealing at 850° C. for 50 hours and then at 1,180° C. for 5 hours. The following Table 5 shows the result.

TABLE 5

| | Properties | | | |
|---|---|---|---|---|
| | $B_{10}$ (T) | $W_{17/50}$ (W/kg) | Adhesion (mm) | Uniformity |
| No addition | 1.92 | 1.11 | 40 | Somewhat ununiform |
| $Sr(OH)_2$:1% (calculated as Sr) | 1.92 | 1.07 | 35 | Uniform |
| $TiO_2$:1.5% (calculated as Ti) | 1.92 | 1.11 | 30 | Uniform |
| $TiO_2$ 1% (as Ti) + $Sr(OH)_2$ 1% (as Sr) | 1.93 | 1.08 | 20 | Uniform |

EXAMPLE 4

A silicon steel ingot containing 0.028% of C, 3.10% of Si, 0.06% of Mn and 0.018% of Se was hot rolled into a thickness of 3 mm, annealed at 950° C. for 5 minutes and then subjected to two cold rollings with an intermediate annealing at 900° C. between them to prepare a cold rolled sheet having a final gauge of 0.30 mm. The cold rolled sheet was subjected to a decarburization annealing, applied with a magnesia series annealing separator containing or not containing a strontium compound and a titanium compound, and subjected to a final annealing at 1,180° C. for 5 hours. The following Table 6 shows the result.

TABLE 6

| | Properties | | | |
|---|---|---|---|---|
| | $B_{10}$ (T) | $W_{17/50}$ (W/kg) | Adhesion (mm) | Uniformity |
| No addition | 1.86 | 1.22 | 45 | Somehwat ununiform |
| $SrSO_4$:1% (calculated as Sr) | 1.87 | 1.15 | 35 | Uniform |
| $TiO_2$:1.5% (calculated as Ti) | 1.87 | 1.23 | 30 | Uniform |
| $TiO_2$1% (as Ti) + $SrSO_4$ 1% (as Sr) | 1.87 | 1.17 | 20 | Uniform |

It can be seen from Examples 3 and 4 that the use of a magnesia series annealing separator containing both of a strontium compound and a titanium compound can produce a uniform electrical insulating film having a high adhesion to the resulting grain-oriented silicon steel sheet without deteriorating the magnetic properties of the steel sheet.

EXAMPLE 5

A silicon steel ingot containing 0.027% of C, 3.02% of Si, 0.05% of Mn, 0.020% of S and 0.020% of Sb was hot rolled into a thickness of 3 mm, annealed at 950° C. for 5 minutes and then subjected to two cold rollings with an intermediate annealing at 900° C. between them to prepare a cold rolled sheet having a final gauge of 0.30 mm. The cold rolled sheet was subjected to a decarburization annealing, applied with a magnesia series annealing separator containing or not containing a strontium compound and a titanium compound, and subjected to a final annealing at 850° C. for 50 hours and then at 1,180° C. for 5 hours. The following Table 7 shows the result.

TABLE 7

| | Properties | | |
|---|---|---|---|
| | $B_{10}$ (T) | $W_{17/50}$ (W/kg) | Adhesion (mm) |
| No addition | 1.90 | 1.15 | 30 |
| $Sr(OH)_2$:1% (calculated as Sr) | 1.91 | 1.12 | 25 |
| $TiO_2$:1.5% (calculated as Ti) | 1.90 | 1.15 | 30 |
| $TiO_2$ 1% (as Ti) + $Sr(OH)_2$ 1% (as Sr) | 1.91 | 1.13 | 25 |

What is claimed is:

1. A method of forming a highly adhesive and uniform insulating film on a grain-oriented silicon steel sheet, without deteriorating the iron loss of the steel sheet, wherein a cold rolled silicon steel sheet having a final gauge is subjected to a decarburization annealing to form a silica-containing subscale on the surface, coated with an annealing separator consisting mainly of magnesia on the subscale and subjected to a final annealing to form an insulating film, an improvement comprising using a magnesia series annealing separator containing 0.1–10% by weight, calculated as strontium, of at least one strontium compound selected from the group consisting of $SrSO_4$, $Sr(OH)_2.8H_2O$, $SrCO_3$, and $Sr(NO_3)_2$, and 0.5–5% by weight, calculated as titanium, of a titanium compound.

* * * * *